US010969178B2

(12) United States Patent
Ojiro

(10) Patent No.: US 10,969,178 B2
(45) Date of Patent: Apr. 6, 2021

(54) HEAT EXCHANGER

(71) Applicant: RINNAI CORPORATION, Aichi (JP)

(72) Inventor: Takashi Ojiro, Aichi (JP)

(73) Assignee: Rinnai Corporation, Aichi (JP)

( * ) Notice: Subject to any disclaimer, the term of this patent is extended or adjusted under 35 U.S.C. 154(b) by 114 days.

(21) Appl. No.: 16/390,182

(22) Filed: Apr. 22, 2019

(65) Prior Publication Data

US 2019/0323783 A1 Oct. 24, 2019

(30) Foreign Application Priority Data

Apr. 23, 2018 (JP) ..... JP2018-082167

(51) Int. Cl.

| | |
|---|---|
| ***F02M 31/08*** | (2006.01) |
| ***F28D 21/00*** | (2006.01) |
| ***F28D 9/00*** | (2006.01) |
| *F28F 3/02* | (2006.01) |

(52) U.S. Cl.
CPC ..... *F28D 21/0003* (2013.01); *F28D 9/005* (2013.01); *F28F 3/027* (2013.01)

(58) Field of Classification Search
CPC ..... F28D 21/0003; F28D 1/0461; F28D 1/06; F28D 21/0007; F28D 7/0075; F28D 9/0043; F28D 9/005; F28D 9/0093; F24H 1/12; F24H 9/0005; F28F 3/00; F28F 3/086; F28F 3/027
USPC ..... 165/52
See application file for complete search history.

(56) References Cited

FOREIGN PATENT DOCUMENTS

| | | | |
|---|---|---|---|
| KR | 20120045249 A | * | 5/2012 |
| KR | 10-1389465 | | 4/2014 |
| KR | 101389465 B1 | * | 4/2014 |

* cited by examiner

*Primary Examiner* — Henry T Crenshaw
*Assistant Examiner* — Kamran Tavakoldavani
(74) *Attorney, Agent, or Firm* — Wenderoth, Lind & Ponack, L.L.P.

(57) ABSTRACT

A heat exchanger includes a plurality of heat exchange units. Each of the plurality of heat exchange units includes: an internal space in which a fluid to be heated flows, a plurality of gas vents penetrating the internal space in a non-communicating state and through which combustion exhaust gas flows, at least one inlet port, and at least one outlet port. At least the one inlet port and at least the one outlet port in each of the heat exchange units are disposed at both ends in a longitudinal direction of the heat exchange unit and are shifted (offset) in a lateral direction of the heat exchange unit.

4 Claims, 5 Drawing Sheets

HEAT EXCHANGER

FIELD OF THE INVENTION

The present invention relates to a heat exchanger having a stacked body formed by stacking a plurality of heat exchange units.

DESCRIPTION OF THE RELATED ART

Conventionally, a heat exchanger including a stacked body formed by stacking a plurality of heat exchange units in which an upper heat exchange plate and a lower heat exchange plate are joined has been proposed (for example, KR 10-1389465 B1). Each of the heat exchange units has an internal space in which a fluid to be heated flows between the upper heat exchange plate and the lower heat exchange plate, and a plurality of gas vents penetrating the internal space in a non-communicating state and through which combustion exhaust gas passes.

Further, each of the heat exchange units has through holes substantially at a center in a front-rear direction at both ends in a left-right direction. Therefore, when the plurality of heat exchange units are stacked, each of the through holes form an inlet port for allowing the fluid to be heated to flow into the internal space or an outlet port for allowing the fluid to be heated to flow out from the internal space. In addition, in the conventional heat exchanger, an inlet pipe for allowing the fluid to be heated to flow into the heat exchanger and an outlet pipe for allowing the fluid to be heated to flow out from the heat exchanger are connected to the through holes from above substantially at the center in the front-rear direction at both ends in the left-right direction of an uppermost heat exchange unit.

In the heat exchanger of KR 10-1389465 B1, the through holes as the inlet port and the outlet port of each of the heat exchange units are located on a center line in the front-rear direction. As a result, the fluid to be heated flowing into the internal space from the inlet port easily flows linearly to the outlet port through a center region in the front-rear direction of the internal space, whereas the fluid to be heated hardly spreads in the front-rear direction of the internal space. Therefore, a flow rate of the fluid to be heated flowing near a corner of the internal space is smaller than that of the fluid to be heated flowing in the center region in the front-rear direction. When such a biased flow of the fluid to be heated is formed, a portion where the flow rate of the fluid to be heated is large and a portion where the flow rate of the fluid to be heated is small are formed in the internal space. As a result, local heating (local boiling) occurs near the corner where the flow rate of the fluid to be heated is small, and noise due to boiling noise may occur. Particularly, in the heat exchanger of KR 10-1389465 B1, the gas vent penetrating the internal space of each of the heat exchange units has an elongated hole shape, and a long side of the gas vent extends in a direction parallel to a flow path direction of the fluid to be heated. Therefore, the flow of the fluid to be heated is not obstructed by the gas vent, and the fluid to be heated easily flows shortly from the inlet port to the outlet port of each of the heat exchange units. As a result, the fluid to be heated further hardly flows near the corner. In addition, when the above-described biased flow of the fluid to be heated is formed, the fluid to be heated is heated uneven by the combustion exhaust gas passing through the gas vents, resulting in lowering of the thermal efficiency.

SUMMARY OF THE INVENTION

The present invention has been made to solve the problems described above, and an object of the present invention is to provide a heat exchanger capable of suppressing noise due to local heating and obtaining high thermal efficiency, by reducing bias of a flow of a fluid to be heated in an internal space of each heat exchange unit.

According to one aspect of the present invention, there is provided a heat exchanger disposed on a downstream side of a gas flow passage of combustion exhaust gas and connected to an inlet pipe for allowing a fluid to be heated to flow in and an outlet pipe for allowing the fluid to be heated to flow out, the heat exchanger comprising a plurality of heat exchange units stacked along a gas flow direction of the combustion exhaust gas, wherein each of the plurality of heat exchange units includes:

an internal space in which the fluid to be heated flows, a plurality of gas vents penetrating the internal space in a non-communicating state and through which the combustion exhaust gas flows, at least one inlet port for allowing the fluid to be heated to flow into the internal space, and at least one outlet port for allowing the fluid to be heated to flow out from the internal space, wherein the internal spaces of adjacent heat exchange units communicate with each other via the outlet port of one heat exchange unit and the inlet port of another heat exchange unit, and at least the one inlet port and at least the one outlet port in each of the heat exchange units are disposed at both ends in a longitudinal direction of the heat exchange unit and are disposed to be shifted (offset) in a lateral direction of the heat exchange unit.

Other objects, features and advantages of the present invention will become more fully understood from the detailed description given hereinbelow and the accompanying drawings which are given by way of illustration only, and thus are not to be considered as limiting the present invention.

DETAILED DESCRIPTION OF THE EMBODIMENTS

Hereinafter, referring to drawings, a heat exchanger and a heat source device according to an embodiment of the present invention will be described in detail.

Figure 1:
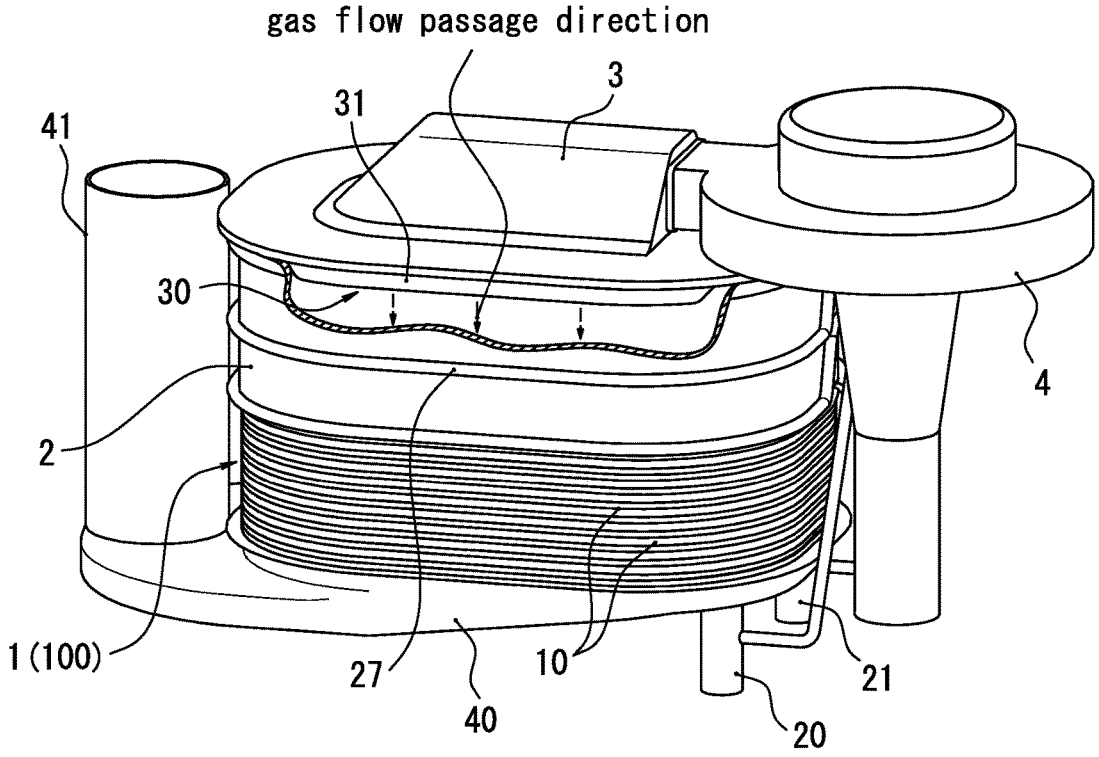
FIG. 1 is a schematic partial cut-away perspective view showing a heat source device according to an embodiment of the present invention.

As shown in FIG. 1, the heat source device according to the present embodiment is a water heater that heats water (a fluid to be heated) flowing into a heat exchanger 1 from an inlet pipe 20 by combustion exhaust gas generated by a burner 31 and supplies hot water to a hot water supplying terminal (not shown) such as a faucet or a shower through an outlet pipe 21. Although not shown, the water heater is accommodated in an outer casing. Other heating medium (for example, an antifreezing fluid) as the fluid to be heated may be used.

In this water heater, a burner body 3 constituting an outer shell of the burner 31, a combustion chamber 2, the heat exchanger 1, and a drain receiver 40 are disposed in order from the top. Additionally, a fan case 4 housing a combustion fan for feeding a mixture gas of fuel gas and air into the burner body 3 is disposed on one side (a right side in FIG. 1) of the burner body 3. Further, an exhaust duct 41 communicating with the drain receiver 40 is disposed on another side (a left side in FIG. 1) of the burner body 3. The combustion exhaust gas flowing out to the drain receiver 40 is discharged to an outside of the water heater through the exhaust duct 41.

In this specification, when the water heater is viewed in a state where the fan case 4 and the exhaust duct 41 are disposed on the sides of the burner body 3, a depth direction corresponds to a front-rear (lateral) direction, a width direction corresponds to a left-right (longitudinal) direction, and a height direction corresponds to a vertical direction.

The burner body 3 has a substantially oval shape in a plan view. The burner body 3 is made of stainless steel-based metal, for example. Although not shown, the burner body 3 opens downward.

An introducing unit communicating with the fan case 4 projects upward from a center of the burner body 3. The burner body 3 includes a flat burner 31 having a downward combustion surface 30. The mixture gas is supplied to the burner body 3 by rotating the combustion fan.

Figure 5:
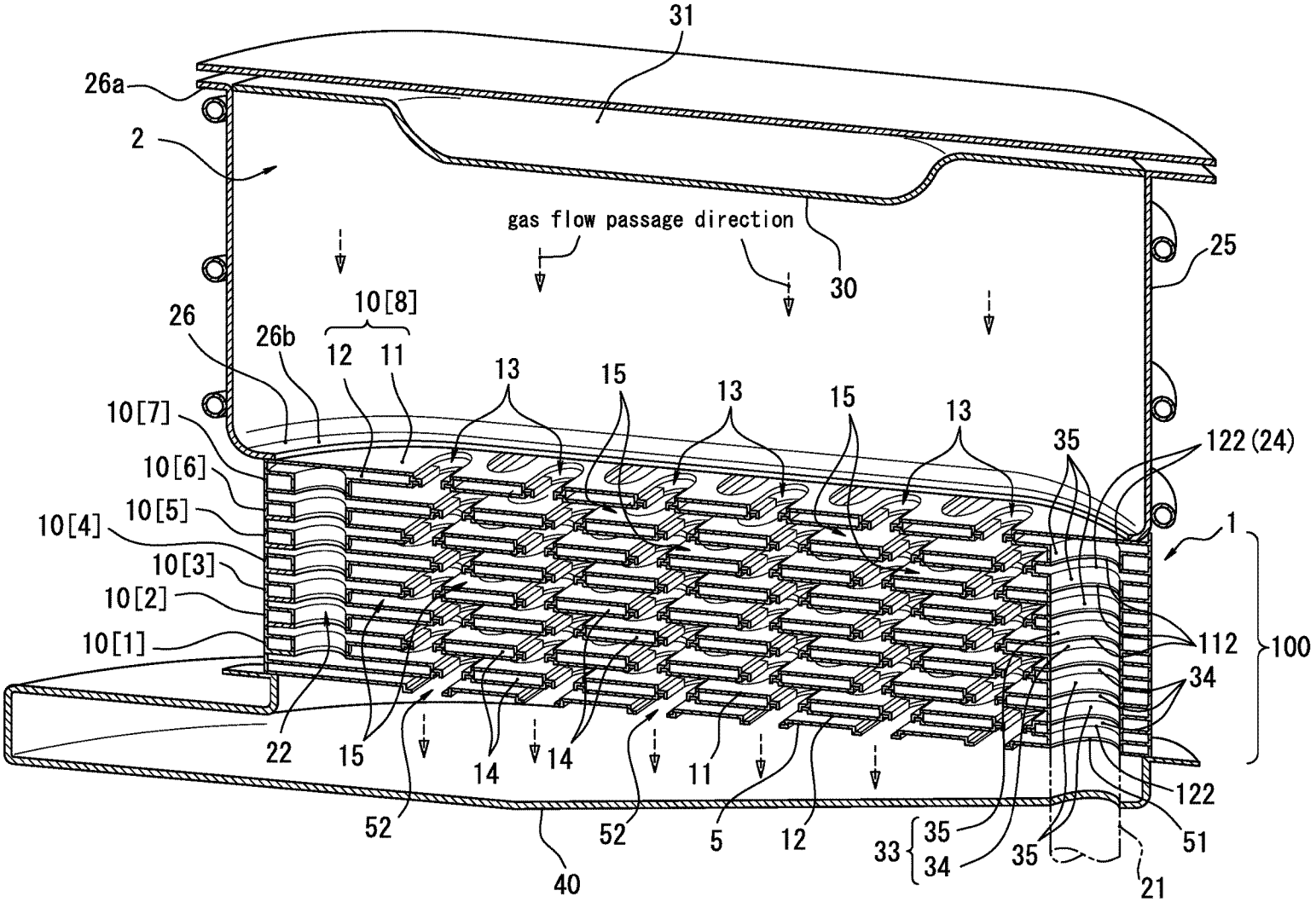
FIG. 5 is a schematic partial cross-sectional perspective view of an outlet pipe side showing the heat exchanger according to the embodiment of the present invention.

The burner 31 is a primary air combustion type burner. The burner 31 includes a ceramic combustion plate having many flame ports opening downwardly (not shown) or a combustion mat made by knitting metal fabric woven like net. The mixture gas supplied into the burner body 3 is jetted downward from the downward combustion surface 30 by supply pressure of the combustion fan. By igniting the mixture gas, flame is formed on the combustion surface 30 of the burner 31 and the combustion exhaust gas is generated. Therefore, the combustion exhaust gas ejected from the burner 31 is fed downward to the heat exchanger 1 via the combustion chamber 2 (as indicated by the arrows of FIG. 1 and FIG. 5). Then, the combustion exhaust gas having passed through the heat exchanger 1 passes through the drain receiver 40 and the exhaust duct 41 and is discharged to the outside of the water heater.

In other words, in the heat exchanger 1, an upper side where the burner 31 is provided corresponds to an upstream side of a gas flow passage of the combustion exhaust gas, and a lower side opposite to the side provided with the burner 31 corresponds to a downstream side of the gas flow passage of the combustion exhaust gas.

The combustion chamber 2 has a substantially oval shape in a plan view. The combustion chamber 2 is made of stainless steel-based metal, for example. The combustion chamber 2 having an upper opening and a lower opening is formed by bending one single metal plate having a substantially rectangular shape and joining both ends thereof. As shown in FIG. 5, a flange 26*a* bent outward is formed at an upper end of the combustion chamber 2, and a flange 26*b* bent inward is formed at a lower end of the combustion chamber 2. These flanges 26*a*, 26*b* are respectively joined to a lower surface peripheral edge of the burner body 3 and an upper surface peripheral edge of the heat exchanger 1.

Figure 4:
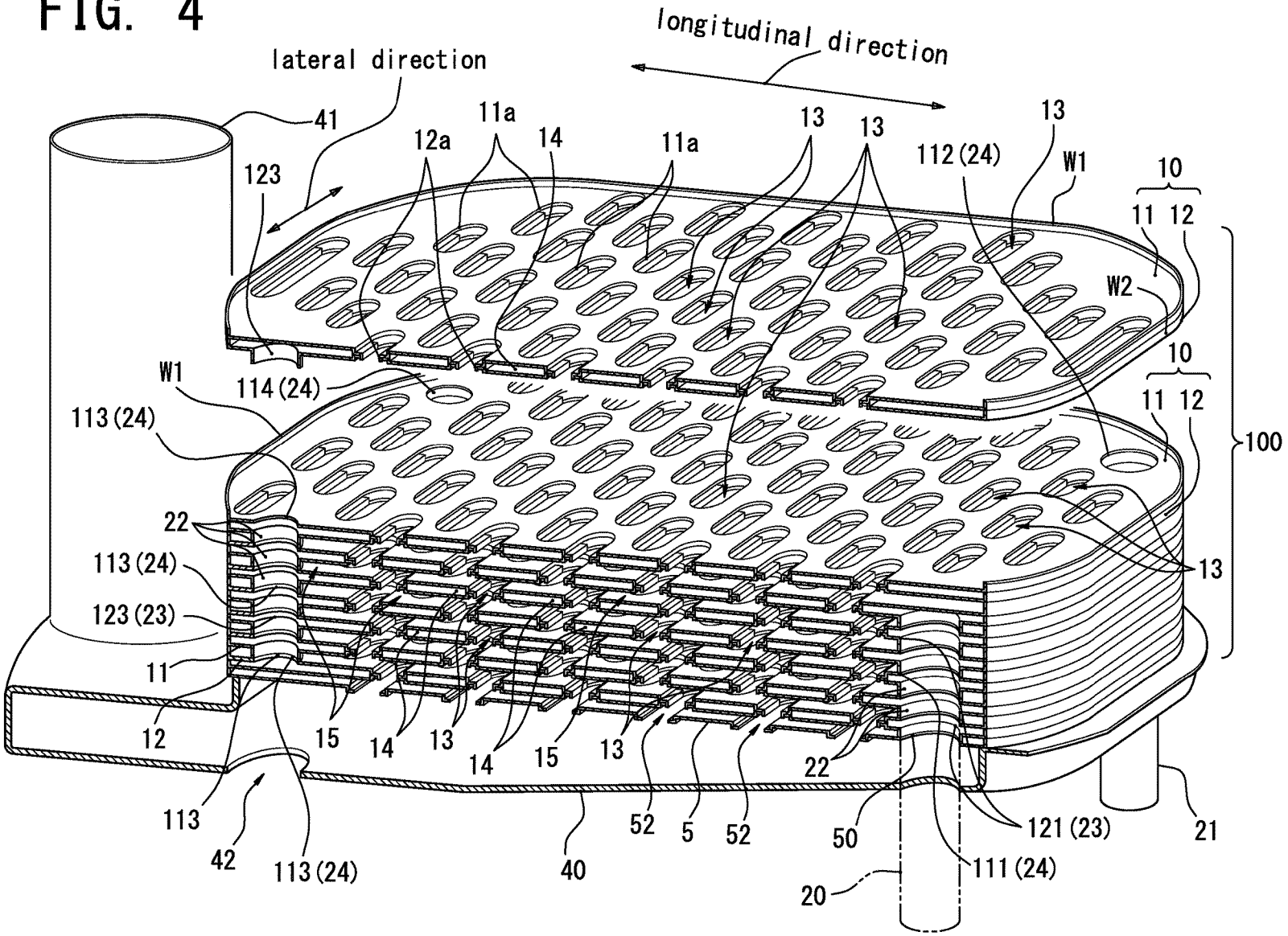
FIG. 4 is a schematic partial cross-sectional perspective view of an inlet pipe side showing the heat exchanger according to the embodiment of the present invention.

The heat exchanger 1 has a substantially oval shape in a plan view. As shown in FIGS. 4 and 5, the heat exchanger 1 has a stacked body 100 formed by stacking a plurality of (in this embodiment, eight) heat exchange units 10 and a deflection plate 5 connected to a lower side of a lowermost heat exchange unit 10. The heat exchanger 1 may have a housing surrounding an outer circumference thereof.

Each of the heat exchange units 10 is formed by superimposing an upper heat exchange plate 11 and a lower heat exchange plate 12 in the vertical direction and joining predetermined portions to be described later with a brazing material or the like. The upper and lower heat exchange plates 11, 12 of each of the heat exchange units 10 respectively have a common configuration, except that some configuration such as a position of a gas vent is different. Therefore, the common configuration will be described first, and the different configuration will be described later. For clarity sake, the dimensions of elements which are represented in the figures do not correspond to the actual dimensions, and do not limit the embodiment.

Figure 3:
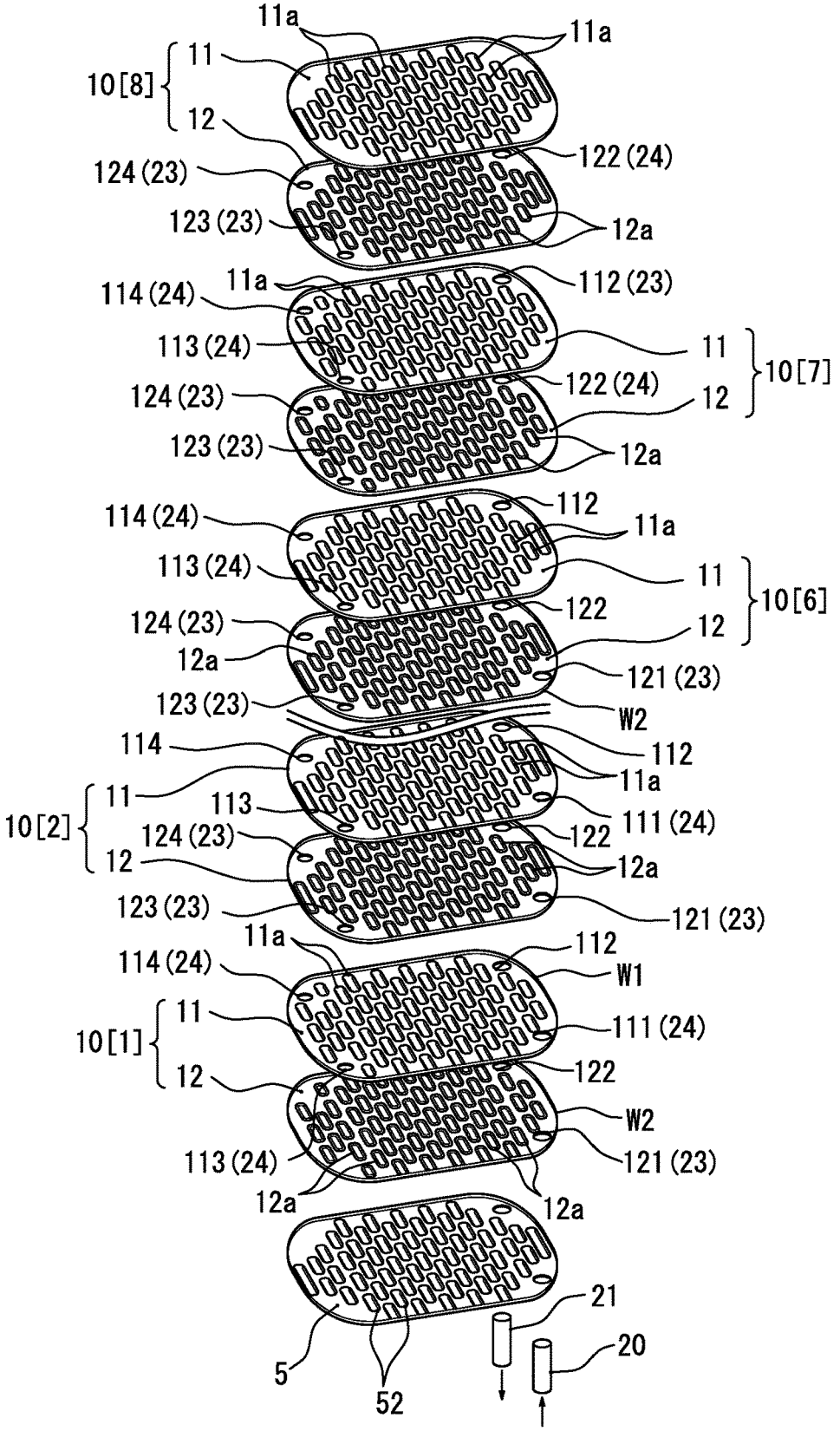
FIG. 3 is a schematic partial exploded perspective view showing heat exchange units of the heat exchanger according to the embodiment of the present invention.

As shown in FIG. 3, the upper and lower heat exchange plates 11, 12 respectively have a substantially oval shape in a plan view. The upper and lower heat exchange plates 11, 12 are made of stainless steel-based metal, for example. The upper and lower heat exchange plates 11, 12 respectively have a number of substantially elongated hole-shaped upper and lower gas vents 11*a*, 12*a* on substantially entire surfaces of the plates except for corners. The upper and lower gas vents 11*a*, 12*a* are formed in such a manner that long sides of the vents 11*a*, 12*a* extend in the front-rear (lateral) direction.

Further, as will be described later, each of the upper and lower heat exchange plates 11, 12, except for an upper heat exchange plate 11 of an uppermost heat exchange unit 10, has substantially circular upper and lower through holes in at least one corner. These upper and lower gas vents 11*a*, 12*a* and a part of the upper and lower through holes are formed by burring so that joints (burring portions) projecting upward or downward from opening edges are formed.

Figure 2:
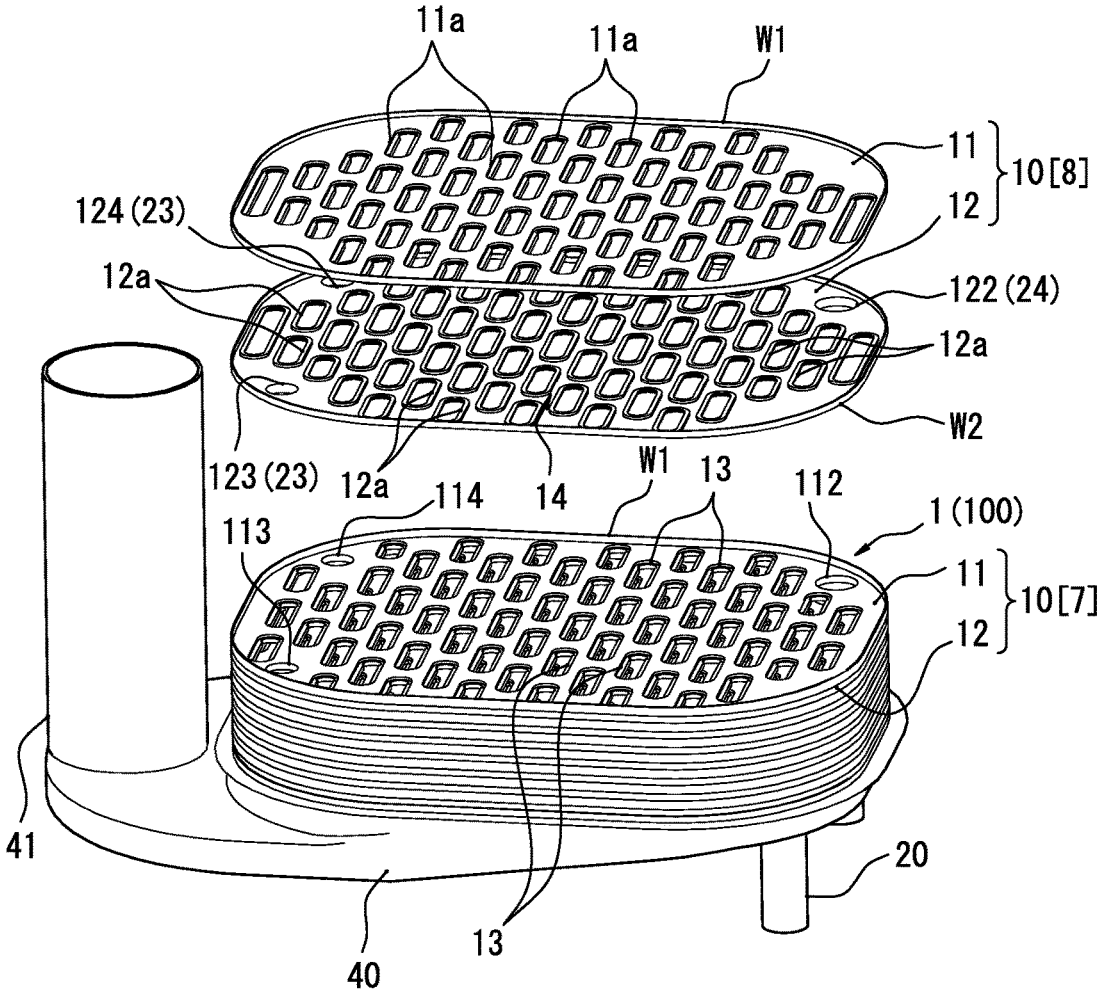
FIG. 2 is a schematic partial exploded perspective view showing a heat exchanger according to the embodiment of the present invention.

As shown in FIG. 2, the upper and lower gas vents 11*a*, 12*a* of the upper and lower heat exchange plates 11, 12 of each of the heat exchange units 10 are provided at positions facing each other. Although not shown, the upper gas vent 11*a* of the upper heat exchange plate 11 has an upper gas vent joint projecting downward at a peripheral edge, and the lower gas vent 12*a* of the lower heat exchange plate 12 has a lower gas vent joint projecting upward at a peripheral edge. Further, upper and lower peripheral edge joints W1, W2 projecting upward are respectively formed on peripheral edges of the upper and lower heat exchange plates 11, 12. The upper and lower heat exchange plates 11, 12 are set in such a manner that when the upper gas vent joints and the lower gas vent joints are joined and further the lower peripheral edge joint W2 and a bottom surface peripheral edge of the upper heat exchange plate 11 are joined, the upper and lower heat exchange plates 11, 12 are spaced from each other at a gap with a predetermined height.

Further, as shown in FIGS. 4 and 5, the upper peripheral edge joint W1 of the upper heat exchange plate 11 is set in such a manner that when the upper peripheral edge joint W1 of the upper heat exchange plate 11 and a bottom surface peripheral edge of the lower heat exchange plate 12 of an upward adjacent heat exchange unit 10 are joined, the upper heat exchange plate 11 of the lower heat exchange unit 10 and the lower heat exchange plate 12 of the upper heat exchange unit 10 are spaced from each other at a gap with a predetermined height. Therefore, by joining the upper and lower gas vent joints of the upper and lower gas vents 11*a*, 12*a* of the upper and lower heat exchange plates 11, 12, and by joining the lower peripheral edge joint W2 of the lower heat exchange plate 12 and the bottom surface peripheral edge of the upper heat exchange plate 11, an internal space 14 of a predetermined height and a gas vent 13 penetrating the internal space 14 in a non-communicating state are formed (in other words, the internal space 14 does not communicate with an interior of the gas vent 13). Furthermore, by joining the plurality of heat exchange units 10, an exhaust space 15 in which the combustion exhaust gas passing through the gas vent 13 flows is formed between vertically adjacent heat exchange units 10.

The gas vents 13 of the vertically adjacent heat exchange units 10 are shifted (offset) by a half pitch (i.e., half of the width of each of the gas vents 13) in the left-right direction perpendicularly intersecting a gas flow direction of the combustion exhaust gas. Therefore, the combustion exhaust gas flowing from the combustion chamber 2 above passes through the gas vent 13 of the one heat exchange unit 10, and then flows out to the exhaust space 15 between the a first upper heat exchange unit 10 and a second lower adjacent heat exchange unit 10. Then, the combustion exhaust gas flowing out to the exhaust space 15 collides with the upper heat exchange plate 11 of the lower adjacent heat exchange unit 10 and further flows downward through the gas vent 13 of the lower adjacent heat exchange unit 10. In other words, when the combustion exhaust gas flows from an upper side of the stacked body 100 to a lower side of the stacked body 100, a zigzag-shaped exhaust gas flow passage is formed in the stacked body 100. As a result, a contact time between the combustion exhaust gas in the heat exchanger 1 and the upper and lower heat exchange plates 11, 12 increases.

Next, the heat exchange unit 10 in each layer will be described with reference to FIG. 3.

Note that a number in a square bracket ([ ]) on a right side of the heat exchange unit 10 in FIGS. 3 and 5 indicates the layer number in series from the bottom when the lowermost heat exchange unit 10 is a first layer.

The lower heat exchange plate 12 which is an element of the first (lowermost) heat exchange unit 10 has lower through holes 121, 122 in front and rear corners on a right side (right short side) in FIG. 3. Further, the upper heat exchange plate 11 of the first heat exchange unit 10 has upper through holes 111 to 114 in four corners. Note that, when the upper and lower heat exchange plates 11, 12 are superimposed with each other, the upper and lower through holes located in the same corner of the upper and lower heat exchange plates 11, 12 of the heat exchange units 10 including the first heat exchange unit 10 are opened so as to be located on a coaxial line.

Further, the two lower through holes 121, 122 each have a lower joint projecting downward from an opening edge, and the upper through hole 112 in a rear corner on a right side of the upper heat exchange plate 11 has an upper joint projecting downward from an opening edge. This upper joint has a height abutting against an upper surface of the lower heat exchange plate 12, when the first upper and lower heat exchange plates 11, 12 are joined together.

Therefore, as described above, when the upper and lower gas vent joints of the upper and lower gas vents 11*a*, 12*a* of the upper and lower heat exchange plates 11, 12 forming the first heat exchange unit 10 are joined, the lower peripheral edge joint W2 of the lower heat exchange plate 12 and the bottom surface peripheral edge of the upper heat exchange plate 11 are joined, and further the upper joint of the upper through hole 112 in the rear corner on the right side of the upper heat exchange plate 11 and the upper surface of the lower heat exchange plate 12 are joined, an internal space 14 of the first heat exchange unit 10 communicates with the lower through hole 121 in the front corner on the right side of the lower heat exchange plate 12, and communicates with the three upper through holes 111, 113, 114 other than the upper through hole 112 in the rear corner on the right side of the upper heat exchange plate 11.

Further, by joining the upper joint of the upper through hole 112 in the rear corner on the right side of the upper heat exchange plate 11 and a peripheral edge of the lower through hole 122 in the rear corner on the right side of the lower heat exchange plate 12, a fluid flow path portion 34 defined in a non-communicating state with the internal space 14 is formed. Therefore, when the inlet pipe 20 is connected to the lower joint of the lower through hole 121 in the front corner on the right side of the lower heat exchange plate 12 via the deflection plate 5 to be described later, water (fluid) flows into the internal space 14 of the first heat exchange unit 10 from the inlet pipe 20. Then, the water (fluid) flows out upward from the internal space 14 via the upper through holes 111, 113, 114 other than the upper through hole 112 in the rear corner on the right side of the upper heat exchange plate 11.

In other words, in the first heat exchange unit 10, an inlet port 23 through which the water flows into the internal space 14 is formed by the one lower through hole 121 in the front corner on the right side of the lower heat exchange plate 12. In addition, outlet ports 24 through which the water flows out from the internal space 14 are formed by the three upper through holes 111, 113, 114 in a front corner on the right side and front and rear corners on a left side of the upper heat exchange plate 11.

In the first heat exchange unit 10, the two outlet ports 24 in the front and rear corners on the left side (that is, the upper through holes 113, 114 in the front and rear corners on the left side of the upper heat exchange plate 11) among the three outlet ports 24 are located to be spaced apart from the inlet port 23 in the front corner on the right side (that is, the lower through hole 121 in the front corner on the right side of the lower heat exchange plate 12) in the left-right direction (i.e., the longitudinal direction with respect to the heat exchange unit 10, as indicated by the arrows in FIG. 4). Further, among the two outlet ports 24 located apart from the inlet port 23 in the left-right (longitudinal) direction, the outlet port 24 formed by the upper through hole 114 in the rear corner on the left side is located on a substantially diagonal line of the heat exchange unit 10 with respect to the inlet port 23. Therefore, the water flowing into the internal space 14 from the inlet port 23 formed by the lower through hole 121 in the front corner on the right side flows toward the outlet port 24 formed by the upper through hole 113 in the front corner on the left side located in the same front as the inlet port 23, the outlet port 24 formed by the upper through hole 114 in the rear corner on the left side located on the substantially diagonal line with respect to the inlet port 23, and the outlet port 24 in the front corner on the right side to be described later.

As described above, in the first heat exchange unit 10, the water flows in the internal space 14 in the left-right (longitudinal) direction, while spreading from the first inlet port 23 toward the two outlet ports 24 located apart from each other in the front-rear direction. Therefore, a partial short circuit of the water flowing in the left-right direction in the internal space 14 is suppressed, and a uniform water flow distribution can be obtained.

Also, since the substantially elongated hole-shaped gas vent 13 is provided so that its long side extends in the front-rear direction (i.e., the lateral direction with respect to the heat exchange unit 10, as indicated by the arrows in FIG. 4), a direction in which the long side of the gas vent 13 extends is substantially orthogonal to a flow path direction of the water flowing in the internal space 14. Accordingly, the water flowing into the internal space 14 from the inlet port 23 collides with the long side of the gas vent 13, thereby flowing to the two outlet ports 24 spaced apart from each other in the front-rear (lateral) direction while the flow path direction of the water is curved. Therefore, the water flowing in the internal space 14 spreads further in the entire internal space 14. As a result, the water easily flows to both ends in the front-rear (lateral) direction of the internal space 14. Thus, the water is efficiently heated. In addition, since a curved flow is formed, a fluid flow path becomes longer. As a result, a heat absorption time increases, and thermal efficiency improves.

In second to fifth heat exchange units 10, upper and lower heat exchange plates 11, 12 of the heat exchange units 10 have the same configuration, except that upper and lower gas vents 11*a*, 12*a* as described above are shifted (offset) by a half pitch in the left-right direction from those of the vertically adjacent heat exchange units 10.

Further, the upper and lower heat exchange plates 11, 12 have four upper through holes 111 to 114 and four lower through holes 121 to 124 at substantially the same positions as the upper through holes 111 to 114 in the four corners of the first upper heat exchange plate 11. Further, the four lower through holes 121 to 124 in four corners of each of those lower heat exchange plates 12 have lower joints projecting downward from opening edges. Moreover, the upper through hole 112 in a rear corner on a right side of each of those upper heat exchange plates 11 has an upper joint projecting downward from an opening edge, same as the first upper heat exchange plate 11. Heights of those upper and lower joints and upper and lower peripheral edge joints W1, W2 of the second to fifth heat exchange units 10 are the same as those of the first heat exchange unit 10.

Therefore, in each of the second to fifth heat exchange units 10, when upper and lower gas vent joints of upper and lower gas vents 11*a*, 12*a* of the upper and lower heat exchange plates 11, 12 are joined, the lower peripheral edge joint W2 of the lower heat exchange plate 12 and a bottom surface peripheral edge of the upper heat exchange plate 11 are joined, and further the upper joint of the upper through hole 112 in the rear corner on the right side of the upper heat exchange plate 11 and an upper surface of the lower heat exchange plate 12 are joined, an internal space 14 formed between the upper and lower heat exchange plates 11, 12 communicates with the three lower through holes 121, 123, 124 in a front corner on a right side and in front and rear corners on a left side of the lower heat exchange plate 12, and communicates with the three upper through holes 111, 113, 114 in a front corner on the right side and front and rear corners on a left side of the upper heat exchange plate 11. Thus, a fluid flow path for guiding the fluid to be heated by the exhaust gas is formed.

Further, each of the lower joints projecting downward from the opening edges of the four lower through holes 121 to 124 of each of the lower heat exchange plates 12 in the second to fifth heat exchange units 10 has a height abutting against an upper surface of the upper heat exchange plate 11 of a downward adjacent heat exchange unit 10, when the heat exchange units 10 are stacked in the vertical direction.

Accordingly, when the lower joints of the three lower through holes 121, 123, 124 in the front corner on the right side and the front and rear corners on the left side of the lower heat exchange plate 12 of one of the second to fifth heat exchange units 10 and the upper surface of the upper heat exchange plate 11 of the downward adjacent heat exchange unit 10 (including the upper heat exchange plate 11 of the first heat exchange unit 10) are joined, and a bottom peripheral edge of the lower heat exchange plate 12 and the upper peripheral edge joint W1 of the upper heat exchange plate 11 of the downward adjacent heat exchange unit 10 are joined, as shown in FIG. 4, an exhaust space 15 as described above and communication paths 22 defined in a non-communicating state with the exhaust space 15 are formed between the vertically adjacent heat exchange units 10.

In other words, in each of the second to fifth heat exchange units 10, inlet ports 23 through which the water (fluid) flows into the internal space 14 are formed by the three lower through holes 121, 123, 124 in the front corner on the right side and the front and rear corners on the left side of the lower heat exchange plate 12. Further, outlet ports 24 through which the water flows out from the internal space 14 are formed by the three upper through holes 111, 113, 114 of the upper heat exchange plate 11 facing the lower through holes 121, 123, 124.

Further, by joining the lower joints of these three inlet ports 23 (that is, the lower through holes 121, 123, 124 in the front corner on the right side and the front and rear corners on the left side of the lower heat exchange plate 12) and the upper surface of the upper heat exchange plate 11 of the downward adjacent heat exchange unit 10, the communication paths 22 for allowing the internal spaces 14 of the vertically adjacent heat exchange units 10 to communicate with each other are formed.

Further, as shown in FIG. 5, by joining a lower joint of a lower through hole 122 in a rear corner on the right side of the lower heat exchange plate 12 and a peripheral edge of the upper through hole 112 in the rear corner on the right side of the upper heat exchange plate 11 of the downward adjacent heat exchange unit 10, a fluid flow path portion 35 defined in a non-communicating state with the exhaust space 15 between the vertically adjacent heat exchange units 10 is formed.

Further, by joining the upper joint of the upper through hole 112 in the rear corner on the right side of the upper heat exchange plate 11 and a peripheral edge of the lower through hole 122 in the rear corner on the right side of the lower heat exchange plate 12, the fluid flow path portion 34 defined in a non-communicating state with the internal space 14 is formed.

Therefore, in the second to fifth heat exchange units 10, same as the first heat exchange unit 10, a part of the water (fluid) flowing into the internal space 14 from the inlet port 23 in the front corner on the right side flows, while colliding with the gas vents 13, toward the outlet port 24 in the front corner on the left side located in the same front as the inlet port 23 and the outlet port 24 in the rear corner on the left side located on the substantially diagonal line with respect to the inlet port 23.

In a sixth heat exchange unit 10 located at a third layer from the top in FIG. 3, upper and lower heat exchange plates 11, 12 have the same configuration as those of the second heat exchange unit 10, except that an upper through hole is not formed in a front corner on a right side of the upper heat exchange plate 11. Therefore, in the sixth heat exchange unit 10, when upper and lower gas vent joints of upper and lower gas vents 11*a*, 12*a* of the upper and lower heat exchange plates 11, 12 are joined, a lower peripheral edge joint W2 of the lower heat exchange plate 12 and a bottom surface peripheral edge of the upper heat exchange plate 11 are joined, and further an upper joint of an upper through hole 112 in a rear corner on the right side of the upper heat exchange plate 11 and an upper surface of the lower heat exchange plate 12 are joined, an internal space 14 formed between the upper and lower heat exchange plates 11, 12 communicates with three lower through holes 121, 123, 124 in a front corner on a right side and front and rear corners on a left side of the lower heat exchange plate 12, and communicates with two upper through holes 113, 114 in front and rear corners on a left side of the upper heat exchange plates 11. Further, by joining the upper joint of the upper through hole 112 in the rear corner on the right side of the upper heat exchange plate 11 and an upper surface of the lower heat exchange plate 12, a fluid flow path portion 34 defined in a non-communicating state with the internal space 14 is formed.

Further, similarly to the above, when the fifth and sixth heat exchange units 10 are joined together, an exhaust space 15 as described above and paths defined in a non-communicating state with the exhaust space 15 are formed. In other words, in the sixth heat exchange unit 10, inlet ports 23 through which the water flows into the internal space 14 are formed by the three lower through holes 121, 123, 124 in the front corner on the right side and the front and rear corners on the left side of the lower heat exchange plate 12. Further, outlet ports 24 through which the water flows out from the internal space 14 are formed by the two upper through holes 113, 114 in the front and rear corners on the left side of the upper heat exchange plate 11. Moreover, by joining the lower joints of these three inlet ports 23 (that is, the lower through holes 121, 123, 124 in the front corner on the right side and the front and rear corners on the left side of the lower heat exchange plate 12) and the upper surface of the upper heat exchange plate 11 of the downward adjacent fifth heat exchange unit 10, fluid communication paths 22 for allowing the internal spaces 14 of the vertically adjacent heat exchange units 10 to communicate with each other are formed.

Further, by joining a lower joint of a lower through hole 122 in a rear corner on the right side of the lower heat exchange plate 12 and a peripheral edge of the upper through hole 112 in the rear corner on the right side of the upper heat exchange plate 11 of the downward adjacent fifth heat exchange unit 10, a fluid flow path portion 35 defined in a non-communicating state with the exhaust space 15 between the vertically adjacent heat exchange units 10 is formed.

In the first to sixth heat exchange units 10, when these heat exchange units 10 are stacked, the inlet port 23 and the outlet port 24 in the front corner on the right side are located on a coaxial line. Therefore, a part of the water flowing into the internal space 14 of the first heat exchange unit 10 flows linearly toward the upper outlet port 24, and flows into the internal space 14 of each of the second to sixth heat exchange units 10 from the outlet port 24 through the communication path 22. Therefore, a part of the water flowing into the first to sixth heat exchange units 10 flows in the same direction (the right to the left in the drawing) of the left-right direction within each of the heat exchange units 10. Thereby, a downstream heat exchange block in which the water flows in the same direction within the internal space 14 is formed.

In a seventh heat exchange unit 10, upper and lower heat exchange plates 11, 12 have the same configuration as those of the fifth heat exchange unit, except that a lower through hole is not formed in a front corner on a right side of the lower heat exchange plate 12, that an upper through hole is not formed in a front corner on a right side of the upper heat exchange plate 11, and that an upper joint is not formed in an upper through hole 112 in a rear corner on the right side of the upper heat exchange plate 11. Therefore, in the seventh heat exchange unit 10, when upper and lower gas vent joints of upper and lower gas vents 11*a*, 12*a* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with all upper and lower through holes 112, 113, 114, 122, 123, 124.

Further, similarly to the above, when the sixth and seventh heat exchange units 10 are joined together, an exhaust space 15 as described above and paths defined in a non-communicating state with the exhaust space 15 are formed. In other words, in the seventh heat exchange unit 10, inlet ports 23 through which the water (fluid) flows into the internal space 14 are formed by the two lower through holes 123, 124 in front and rear corners on a left side of the lower heat exchange plate 12. Further, outlet ports 24 through which the water (fluid) flows out from the internal space 14 are formed by the two upper through holes 113, 114 in front and rear corners on a left side of the upper heat exchange plate 11. Moreover, by joining lower joints of these two inlet ports 23 (that is, the lower through holes 123, 124 in the front and rear corners on the left side of the lower heat exchange plate 12) and the upper surface of the upper heat exchange plate 11 of the downward adjacent sixth heat exchange unit 10, fluid communication paths 22 for allowing the internal spaces 14 of the vertically adjacent heat exchange units 10 to communicate with each other are formed.

Further, by joining a lower joint of the lower through hole 122 in a rear corner on the right side of the lower heat exchange plate 12 and a peripheral edge of the upper through hole 112 in the rear corner on the right side of the upper heat exchange plate 11 of the downward adjacent sixth heat exchange unit 10, a fluid flow path portion 35 defined in a non-communicating state with the exhaust space 15 between the vertically adjacent heat exchange units 10 is formed. The fluid flow path portion 35 communicates with the internal space 14 of the seventh heat exchange unit 10. Since an upper joint is not formed in an opening edge of the upper through hole 112, an outlet port 24 for allowing the water to flow from the internal space 14 of the seventh heat exchange unit 10 to the internal space 14 of the sixth heat exchange unit 10 is formed by the lower through hole 122.

As described above, the lower heat exchange plate 12 of the seventh heat exchange unit 10 has no lower through hole in the front corner on the right side, different from those of the first to sixth heat exchange units. Therefore, in the seventh heat exchange unit 10, a part of the water flowing into the internal space 14 from the two inlet ports 23 in the front and rear corners on the left side flows, while colliding with gas vents 13, toward the outlet port 24 in the rear corner on the right side of the lower heat exchange plate 12 located on a substantially diagonal line with respect to the inlet port 23 in the front corner on the left side in a direction opposite to the direction of the water flowing in the internal spaces 14 of the first to sixth heat exchange units 10 (from the left to the right in the drawing).

In an eighth (uppermost) heat exchanger unit 10 located furthest upstream with respect to the gas flow direction of the combustion exhaust gas, upper and lower heat exchange plates 11, 12 have the same configuration as those of the sixth heat exchange unit 10, except that a lower through hole is not formed in a front corner on a right side of the lower heat exchange plate 12 and that an upper through hole is not formed in the upper heat exchange plate 11. Therefore, in the eighth heat exchanger unit 10, when upper and lower gas vent joints of upper and lower gas vents 11*a*, 12*a* of the upper and lower heat exchange plates 11, 12 are joined, and a lower peripheral edge joint W2 of the lower heat exchange plate 12 and a bottom surface peripheral edge of the upper heat exchange plate 11 are joined, an internal space 14 formed between the upper and lower heat exchange plates 11, 12 communicates with all lower through holes 122, 123, 124.

Further, similarly to the above, when the seventh and eighth heat exchange units 10 are joined together, an exhaust space 15 as described above and paths defined in a non-communicating state with the exhaust space 15 are formed. In other words, in the eighth heat exchange unit 10, inlet ports 23 through which the water flows into the internal space 14 are formed by the two lower through holes 123, 124 in front and rear corners on a left side of the lower heat exchange plate 12. Further, an outlet port 24 through which the water flows out from the internal space 14 is formed by the lower through holes 122 in a rear corner on the right side of the lower heat exchange plate 12. Moreover, by joining lower joints of these two inlet ports 23 (that is, the lower through holes 123, 124 in the front and rear corners on the left side of the lower heat exchange plate 12) and an upper surface of the upper heat exchange plate 11 of the downward adjacent seventh heat exchange unit 10, communication paths 22 for allowing the internal spaces 14 of the vertically adjacent heat exchange units 10 to communicate with each other are formed.

Further, by joining a lower joint of the lower through hole 122 in the rear corner on the right side of the lower heat exchange plate 12 and a peripheral edge of the upper through hole 112 in the rear corner on the right side of the upper heat exchange plate 11 of the downward adjacent seventh heat exchange unit 10, a flow path 35 defined in a non-communicating state with the exhaust space 15 between the vertically adjacent heat exchange units 10 is formed. The flow path 35 communicates with the internal spaces 14 of the seventh and eighth heat exchange units 10.

In the eighth heat exchange unit 10, same as the seventh heat exchange unit 10, the water (fluid) flowing into the internal space 14 from the two inlet ports 23 in the front and rear corners on the left side flows, while colliding with gas vents 13, toward the outlet port 24 in the rear corner on the right side of the lower heat exchange plate 12 located on a substantially diagonal line with respect to the inlet port 23 in the front corner on the left side.

In the seventh to eighth heat exchange units 10, when these heat exchange units 10 are stacked, the inlet ports 23 and the outlet ports 24 in the front and rear corners on the left side are located on coaxial lines, respectively. Therefore, a part of the water flowing into the internal space 14 of the seventh heat exchange unit 10 flows linearly toward the upper outlet ports 24, and flows into the internal space 14 of the eighth heat exchange unit 10 from the outlet ports 24 through the communication paths 22. Therefore, the water flowing into the seventh to eighth heat exchange units 10 flows in the same direction (the left to right in the drawing) of the left-right direction within each of the heat exchange units 10.

Further, the outlet port 24 in the rear corner on the right side of the eighth heat exchange unit 10 communicates with the internal space 14 of the seventh heat exchange unit 10 via the flow path 35 defined in the non-communicating state with the exhaust space 15 between the seventh and eighth heat exchange units 10 as described above and the upper through hole 112 in the rear corner on the right side of the upper heat exchange plate 11 of the seventh heat exchange unit 10. Therefore, a communication path through which the water flows from an upper side to a lower side is formed by the above fluid flow path portion 35, whereby the flow path direction of the water is folded back in the stacked body 100. The outlet ports 24 in the rear corners on the right side of these seventh and eighth heat exchange units 10 (that is, the lower through holes 122 in the rear corners on the right side of these lower heat exchange plates 12) are located above the fluid flow path portions 34 defined in the non-communicating state with the internal spaces 14 of the first to sixth heat exchange units 10 and the fluid flow path portions 35 defined in the non-communicating state with the exhaust spaces 15 between the vertically adjacent heat exchange units 10 of the first to seventh heat exchange units 10.

Furthermore, the fluid flow path portion 34 defined in the non-communicating state with the internal space 14 of the first heat exchange unit 10 communicates with the lower through hole 122 in the rear corner on the right side of the lower heat exchange plate 12 of the first heat exchange unit 10.

Therefore, the water flowing out from the outlet ports 24 in the rear corners on the right side of the seventh and eighth heat exchange units 10 flows downward through the fluid flow path portions 34, 35 respectively penetrating the internal spaces 14 of the heat exchange units 10 located below these outlet ports 24 and the exhaust space 15 between the heat exchange units 10 located below these outlet ports 24 in the non-communicating state.

Further, a part of the water flowing in the seventh heat exchange unit 10 does not flow into the eighth heat exchange unit 10 and flows out from the outlet port 24 in the rear corner on the right side of the seventh heat exchange unit 10. Therefore, the outlet port 24 of the eighth heat exchange unit 10 and the outlet port 24 in the rear corner on the right side of the seventh heat exchange unit 10 communicating with the outlet port 24 of the eighth heat exchange unit 10 via the flow path 35 (that is, the lower through holes 122 in the rear corners on the right side of the lower heat exchange plates 12 of these heat exchange units 10) form final outlet ports through which the water flows out to the outlet pipe 21 via a fluid outflow path 33 to be described below.

Further, a joint body located on a coaxial line with the final outlet ports and formed by joining the fluid flow path portion 34 penetrating the internal spaces 14 of the first to sixth heat exchange units 10 in the non-communicating state and the fluid flow path portion 35 penetrating the exhaust spaces 15 between the first to seventh heat exchange units 10 in the non-communicating state forms the fluid outflow path 33.

The deflection plate 5 is disposed below the first heat exchange unit 10. The deflection plate 5 has the same configuration as those of the lower heat exchange plate 12 of the first heat exchange unit 10, except that passing holes 52 are shifted (offset) by a half pitch in the left-right direction from the gas vents 13 of the first heat exchange unit 10. Therefore, two through holes 50, 51 in front and rear corners on a right side of the deflection plate 5 and the lower through holes 121, 122 in the front and rear corners on the right side of the lower heat exchange plate 12 of the first heat exchange unit 10 are located on coaxial lines, respectively.

By joining the lower joints of the two lower through holes 121, 122 in the front and rear corners on the right side of the lower heat exchange plate 12 of the first heat exchange unit 10 and peripheral edges of the two through holes 50, 51 of the deflection plate 5, respectively, an exhaust space 15 and paths defined in a non-communicating state with the exhaust space 15 between the first heat exchange unit 10 and the deflection plate 5 are formed. Therefore, the combustion exhaust gas ejected from the burner 31 flows downward from the eighth heat exchange unit 10 to the first heat exchange unit 10, while heating those heat exchange units 10 in the stacked body 100. Further, the combustion exhaust gas passing through the gas vents 13 of the lowermost heat exchange unit 10 flows in the exhaust spaces 15 between the lower heat exchange plate 12 of the lowermost heat exchange unit 10 and the deflection plate 5. Thus, even the lowermost heat exchange unit 10 can heat the water flowing in the internal space 14 from both upper and lower surfaces, and thermal efficiency can be further improved.

The inlet port 23 of the lowermost heat exchange unit 10 is connected to the inlet pipe 20 via the through hole 50 in the front corner on the right side of the deflection plate 5. Further, an lower end of the outflow path 33 is connected to the outlet pipe 21 via the through hole 51 in the rear corner on the right side of the deflection plate 5.

According to the heat exchanger 1 having the above configuration, the water supplied from the inlet pipe 20 flows into the stacked body 100 via the inlet port 23 of the first heat exchange unit 10. In addition, in the vertically adjacent heat exchange units 10, at least one outlet port 24 of the one heat exchange unit 10 and at least one inlet port 23 of the other heat exchange unit 10 are connected to each other via the fluid communication path 22. Accordingly, the water (fluid) flowing from the inlet pipe 20 into the lowermost heat exchange unit 10 flows from the lower side to the upper side (the downstream side to the upstream side with respect to the gas flow direction of the combustion exhaust gas) in the stacked body 100. Further, the water flowing from the lower side to the upper side in the stacked body 100 flows out from the final outlet ports of the seventh and eighth heat exchange units 10 constituting the burner side-heat exchange block to the outlet pipe 21 via the outflow path 33 formed so as to penetrate the stacked body 100 below the seventh and eighth heat exchange units 10.

Further, according to the heat exchanger 1 having the above configuration, at least the one outlet port 24 and at least the one inlet port 23 of any of the heat exchange units 10 are located on the substantially diagonal line of the heat exchange unit 10. For example, in the first heat exchange unit 10, the water flows into the internal space 14 from the lower through hole 121 in the front corner on the right side of the lower heat exchange plate 12 as the inlet port 23. In addition, the upper through hole 114 in the rear corner on the left side of the upper heat exchange plate 11, as one of the outlet ports 24, is located on the substantially diagonal line with respect to the lower through hole 121 in the front corner on the right side. In other words, at least the one outlet port 24 and at least the one inlet port 23 in the heat exchange unit 10 are disposed so as to be shifted (offset from each centerline in opposite directions) in a longitudinal direction and a lateral direction of the heat exchange unit 10. Therefore, in each of the heat exchange units 10, the water flowing into the internal space 14 from at least the one inlet port 23 flows, while spreading in the internal space 14 toward at least the one outlet port 24 located on the substantially diagonal line with respect to the inlet port 23. Therefore, a travel distance of the water becomes longer, and unbalance of water flow in the internal space 14 can be reduced. As a result, a uniform water flow distribution is formed in the internal space 14. Thus, local heating hardly occurs, and noise due to boiling noise can be suppressed. In addition, thermal efficiency of each of the heat exchange units 10 can be improved.

Further, according to the heat exchanger 1 having the above configuration, each of the heat exchange units 10 includes the gas vents 13, each of which has the long side extending in the direction substantially orthogonal to the flow path direction of the water in the internal space 14. Therefore, the water flowing in the internal space 14 flows from the inlet port 23, while colliding with the long sides of the gas vents 13, toward the outlet port 24. Thereby, the fluid flow path of the water in the internal space 14 becomes longer.

Thus, it makes possible to increase a heat absorption time and improve thermal efficiency.

Further, in the embodiment above, the burner 31 having the downward combustion surface 30 is disposed above the heat exchanger 1. However, a burner having an upward combustion surface may be disposed below the heat exchanger. In addition, a burner having a sideward combustion surface may be disposed on one of the right side and the left side of the stacked body.

In the embodiment above, the water heater is used. However, a heat source device such as a boiler may be used.

Further, in the embodiment above, the vertically adjacent heat exchange units 10 are stacked in such a manner that the exhaust space 15 is formed therebetween. However, the plurality of heat exchange units 10 may be stacked without providing the exhaust space 15.

The heat exchanger may have a substantially rectangular shape or a substantially circular shape in a plan view. When the heat exchanger has the substantially circular shape in the plan view, the inlet port and the outlet port are disposed in point symmetry with respect to a center point of the circular.

As described in detail, the present invention is summarized as follows.

According to one aspect of the present invention, there is provided a heat exchanger disposed on a downstream side of a gas flow passage of combustion exhaust gas and connected to an inlet pipe for allowing a fluid to be heated to flow in and an outlet pipe for allowing the fluid to be heated to flow out, the heat exchanger comprising a plurality of heat exchange units stacked along a gas flow direction of the combustion exhaust gas, wherein each of the plurality of heat exchange units includes:

an internal space in which the fluid to be heated flows, a plurality of gas vents penetrating the internal space in a non-communicating state and through which the combustion exhaust gas flows, at least one inlet port for allowing the fluid to be heated to flow into the internal space, and at least one outlet port for allowing the fluid to be heated to flow out from the internal space, wherein the internal spaces of adjacent heat exchange units communicate with each other via the outlet port of one heat exchange unit and the inlet port of another heat exchange unit, and at least the one inlet port and at least the one outlet port in each of the heat exchange units are disposed at both ends in a longitudinal direction of the heat exchange unit and are disposed to be shifted (offset) in a lateral direction of the heat exchange unit.

According to the heat exchanger described above, at least the one inlet port and at least the one outlet port in each of the heat exchange units are disposed at both ends in the longitudinal direction of the heat exchange unit and are disposed to be shifted (offset) in the lateral direction of the heat exchange unit. Therefore, a travel distance of the fluid to be heated flowing into the internal space from the inlet port becomes longer since the one inlet port and the one outlet port are shifted (offset) in the longitudinal direction and in the lateral direction. Thus, the fluid to be heated flows from the inlet port toward the outlet port, while spreading in the internal space. Thereby, bias of a flow of the fluid to be heated in the internal space can be reduced.

Preferably, in the heat exchanger described above, each of the heat exchange units has a substantially rectangular shape or a substantially oval shape in a plan view, at least the one inlet port in each of the heat exchange units is provided in vicinity of at least one corner of each of the heat exchange units, at least the one outlet port in each of the heat exchange units is provided in vicinity of another corner different from the one corner where the inlet port is provided, and at least the one inlet port and at least the one outlet port are located on a substantially diagonal line of each of the heat exchange units.

According to the heat exchanger described above, at least the one inlet port in each of the heat exchange units is provided in the vicinity of at least the one corner of each of the heat exchange units having the substantially rectangular shape or the substantially oval shape in the plan view. Therefore, it makes possible to flow the fluid to be heated from the corner where the fluid to be heated hardly flows into the internal space, as compared with the conventional heat exchanger.

Further, according to the heat exchanger described above, at least the one outlet port is provided in the vicinity of the other corner located on the substantially diagonal line of each of the heat exchange units with respect to the inlet port in the vicinity of the one corner. Therefore, the fluid to be heated flowing into the internal space from the inlet port flows, while spreading in the internal space, toward the outlet port. Thereby, the bias of the flow of the fluid to be heated in the internal space can be further reduced.

Preferably, in the heat exchanger described above, the gas vents has an elongated hole shape including a long side extending in a direction substantially orthogonal to a flow path direction of the fluid to be heated flowing in the internal space of each of the heat exchange units.

According to the heat exchanger described above, the fluid to be heated flows from the inlet port, while colliding with the long sides of the gas vents, toward the outlet port. Therefore, the travel distance of the fluid to be heated flowing in the internal space becomes longer, and it makes possible to increase a heat absorption time.

Preferably, the heat exchanger described above further comprises:

a deflection plate including a plurality of passing holes through which the combustion exhaust gas passes on the downstream side of the gas flow passage of the combustion exhaust gas more than a most downstream heat exchange unit located on a most downstream side of the gas flow passage of the combustion exhaust gas, wherein, when the deflection plate is viewed from the downstream side of the gas flow passage of the combustion exhaust gas, the passing holes are disposed to be shifted (offset) from the gas vents of the most downstream heat exchange unit.

In the conventional heat exchange unit located on the most downstream side of the gas flow passage of the combustion exhaust gas, the combustion exhaust gas directly flows to the downstream side after the combustion exhaust gas passes through the gas vent of the most downstream heat exchange unit. As a result, heat of the combustion exhaust gas is insufficiently absorbed on the downstream side of the most downstream heat exchange unit. However, according to the heat exchanger described above, the most downstream heat exchange unit located on the most downstream side can be heated from the downstream side by the combustion exhaust gas passing through the gas vent of the most downstream heat exchange unit.

According to the present invention, in the heat exchanger formed by stacking the plurality of heat exchange units, the bias of the flow of the fluid to be heated in the internal space can be reduced. Accordingly, there is provided the heat exchanger capable of suppressing noise due to local heating and obtaining high thermal efficiency.

The present application claims a priority based on a Japanese Patent Application No. 2018-82167 filed on Apr. 23, 2018, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A heat exchanger to be disposed on a downstream side of a gas flow of combustion exhaust gas produced by a burner, the heat exchanger being connected to an inlet pipe for allowing a fluid to be heated by the combustion exhaust gas to flow in, and connected to an outlet pipe for allowing the fluid to flow out, the heat exchanger comprising:

a plurality of heat exchange units stacked along a gas flow direction of the combustion exhaust gas, wherein each of the plurality of heat exchange units has one of a rectangular shape or oval shape in plan view, and includes:

an internal space in which the fluid flows, a plurality of gas vents penetrating the internal space so as not to communicate with the internal space and through which the combustion exhaust gas flows, an inlet port for allowing the fluid to flow into the internal space, and an outlet port for allowing the fluid to flow out from the internal space, wherein adjacent heat exchange units of the plurality of heat exchange units have respective internal spaces in communication with each other via the outlet port of a first one of the adjacent heat exchange units and the inlet port of a second one of the adjacent heat exchange units such that the fluid flows from the internal space of the first one of the adjacent heat exchange units into the internal space of the second one of the adjacent heat exchange units, and the inlet port and the outlet port of each of the heat exchange units are disposed at opposite ends with respect to a longitudinal direction of the respective heat exchange unit and are disposed to be offset with respect to a lateral direction of the respective heat exchange unit.

2. The heat exchanger according to claim 1, wherein the inlet port of each of the heat exchange units is provided in a vicinity of a first corner of the respective one of the heat exchange units, wherein the outlet port of each of the heat exchange units is provided in a vicinity of a second corner of the respective one of the heat exchange units, the second corner being different from the first corner where the inlet port is provided, and wherein the inlet port and the outlet port are located on a virtual substantially diagonal line formed across the respective one of the heat exchange units.

3. The heat exchanger according to claim 1, wherein each of the gas vents has an elongated shape including a long side extending in a direction substantially orthogonal to a fluid flow direction of the fluid flowing through the internal space of each of the heat exchange units.

4. The heat exchanger according to claim 1, further comprising:

a deflection plate including a plurality of passing holes through which the combustion exhaust gas passes on the downstream side of the heat exchanger relative to the gas flow direction of the combustion exhaust gas such that the deflection plate is located further downstream relative to the gas flow direction than any of the plurality of heat exchange units, wherein, when the deflection plate is viewed from the downstream side with respect to the gas flow direction of the combustion exhaust gas, a position of the passing holes offset relative to a position of the gas vents of one of the plurality of heat exchange units located furthest downstream with respect to the gas flow direction.

* * * * *